United States Patent [19]

De Vrij

[11] Patent Number: 4,632,853

[45] Date of Patent: Dec. 30, 1986

[54] DOUBLE GLASS COVERING AND PROCESS FOR ITS MANUFACTURE

[75] Inventor: Simone M. De Vrij, Deurne, Belgium

[73] Assignee: Atlas Isolaties, personenvennootschap met beperkte aansprakelijkheid, Deurne, Belgium

[21] Appl. No.: 558,812

[22] Filed: Dec. 7, 1983

[30] Foreign Application Priority Data

Dec. 9, 1982 [BE] Belgium ..... 2/59945

[51] Int. Cl.[4] ..... E06B 3/24

[52] U.S. Cl. ..... 428/34; 52/171; 52/788; 52/790; 428/38

[58] Field of Search ..... 428/34, 38, 326; 52/170, 173 R, 171, 788, 790

[56] References Cited

U.S. PATENT DOCUMENTS

| | | | |
|---|---|---|---|
| 2,877,515 | 3/1959 | Haas | 52/172 |
| 3,573,149 | 3/1971 | Tibble | 428/34 |
| 3,760,157 | 9/1973 | Newman et al. | 219/522 |
| 4,074,480 | 2/1978 | Burton | 52/127 |
| 4,198,254 | 4/1980 | LaRoche | 156/107 |
| 4,208,849 | 6/1980 | Lamb | 52/203 |
| 4,348,435 | 9/1982 | Mistrick | 428/34 |

FOREIGN PATENT DOCUMENTS

| | | | |
|---|---|---|---|
| 662248 | 12/1951 | United Kingdom . | |
| 1206751 | 9/1970 | United Kingdom | 428/34 |
| 2025500 | 1/1980 | United Kingdom | 428/34 |

OTHER PUBLICATIONS

"Points de Vue Sur les Produits", Societe francaise des petroles, B. P.

*Primary Examiner*—George F. Lesmes
*Assistant Examiner*—P. R. Schwartz
*Attorney, Agent, or Firm*—Schwartz, Jeffery, Schwaab, Mack, Blumenthal & Evans

[57] ABSTRACT

Double glass set of the type formed by an existing single glass set and a supplementary glass set with there between a spacer the sides of which are provided with an adhesive material that forms an airtight assembly between the spacer and glass sets, characterized in that the spacer is formed by a metallic profile (4-5-6-7), preferably in aluminium, which shows a rectangular section and the outside wall of which is provided with an L-shaped rib (16), the free flange of which is oriented towards the supplementary glass set (11), while the inside wall is prolonged past the side walls in order to form projections (21-22).

18 Claims, 4 Drawing Figures

DOUBLE GLASS COVERING AND PROCESS FOR ITS MANUFACTURE

The present invention relates to a double glass covering, in other words to an insulating glass covering, which is mounted between a double glass covering properly speaking and a frame mounted before.

In fact, the double glass covering according to the invention is chiefly characterized in that it has an insulation which is as effective as that of a double glass covering, on the one hand, and can be mounted approximately in the same way as a traditional frame to be mounted before.

Such a double glass cover mainly consists of an existing glass cover; at a determined distance of this existing glass cover, a supplementary glass cover and, between the two glass covers, a frame on which on each side an adhesive matter is provided for which forms an airtight connection between frame and glass cover, and relating to the space between the glasses, a means absorbing moisture.

Such double glass covers have already been propounded in various ways, whereby the adhesive material is always warmed up by electric resistance elements, which run through the adhesive material, with as a drawback the fact that the resistance components have a very small section, so that they must be heated up to a high temperature in order to heat the adhesive material as necessary.

Thereby there is obtained that these components burn regularly before they have carried out their work, so that a bad adhesion or no adhesion at all is obtained.

One also obtains that due to the great heat the adhevise material may degenerate and/or that the spacing means between the existing glass sets and the supplementary glass set become deformed.

Other disadvantages of the known double glass sets of the type as intended by the present invention are the possibility of an unequal thickness of the adhesive material; the possibility of expulsing the adhesive material, during the application of the supplementary glass set, in such a way that the remaining thickness be insufficient to obtain a good adhesion and a good tightness; to great a direct contact of the adhesive material with the space between the glass sets, which is detrimental for the permeability to vapours; an irregular alignment of the adhesive material in relation to the visible part of the inside space of the glass set; etc.

The present invention therefore relates to a double glass set of the aforesaid type whereby the aforesaid and other disadvantages of the known glass sets are totally excluded.

This double glass set consists therefore of an existing single glass set and of a supplementary glass set with in between a spacing component the sides of which are provided with an adhesive material forming an airtight assembly between the spacing component and the glass sets and whereby the spacing component is formed by a metallic profile, preferably of aluminium, which has a rectangular section and the outside wall of which is provided with an L-shaped rib the free flange of which is oriented towards the supplementary glass set, whilst the inner wall is lengthened past the side walls in order to form projections.

In order better to show the characteristics of the invention, hereinafter, as an example without any limiting character, a preferred form of execution is described, reference being made to the attached drawings, wherein.

Figure 1:
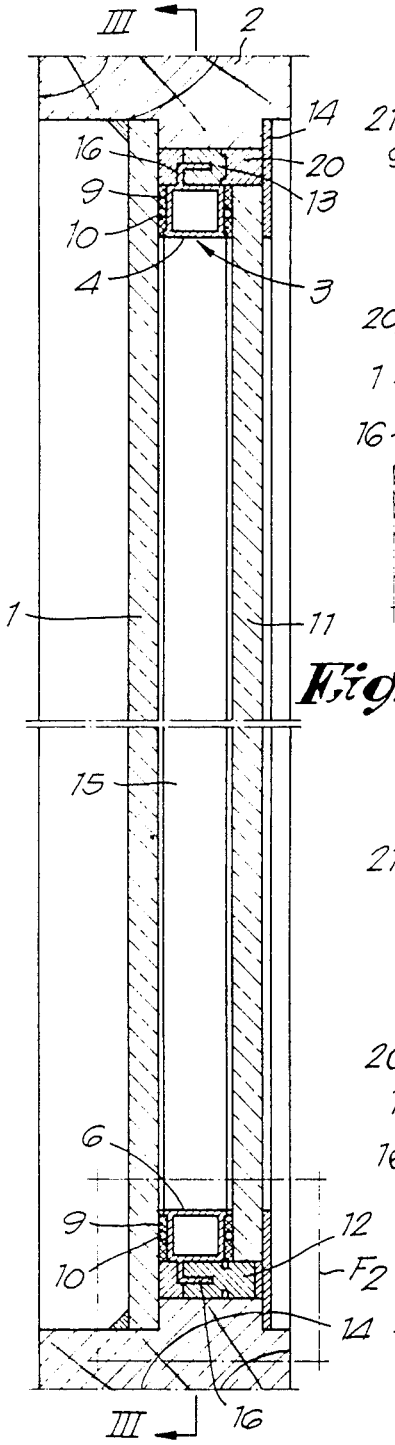
FIG. 1 shows a vertical section through a double glass set according to the invention.

As represented in the attached drawing, the double glass covering according to the invention comprises an existing single glass set 1, which is fixed in a frame 2. Against this glass set 1, a frame 3 is mounted. Frame 3 mainly consists of profiles 4-5-6 and 7 which are appropriately assembled by means of corner pieces 8, for instance through clamping, and which carry on each side a strip of fusible material 9, for instance on a butyl base. In whereby in the embodiment according to FIG. 2, in these strips of material 9, a distance component is provided for, for instance a thread made of PVC. A supplementary single glass set 11 is also provided. Spacers 12 are mounted on the underside and spacer 13 are mounted on the upper side and vertical sides of the frame 3, and an appropriate covering lath 14, in PVC, aluminium or the like is provided.

Figure 2:
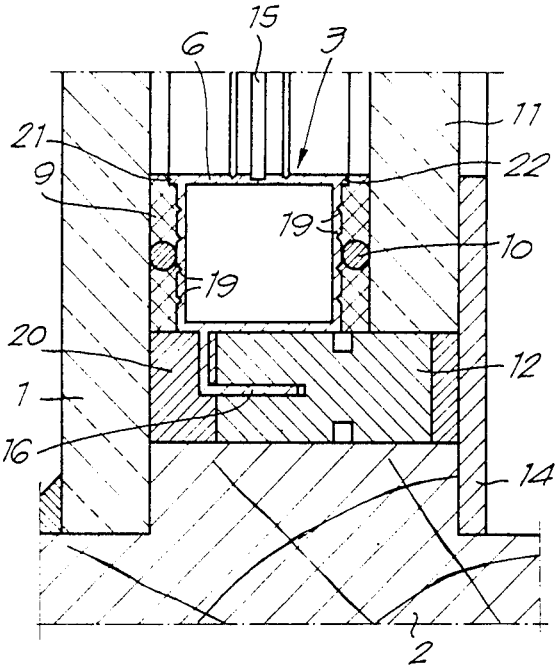
FIG. 2 shows on a larger scale the part which is indicated in FIG. 1 by F2.
Figure 3:
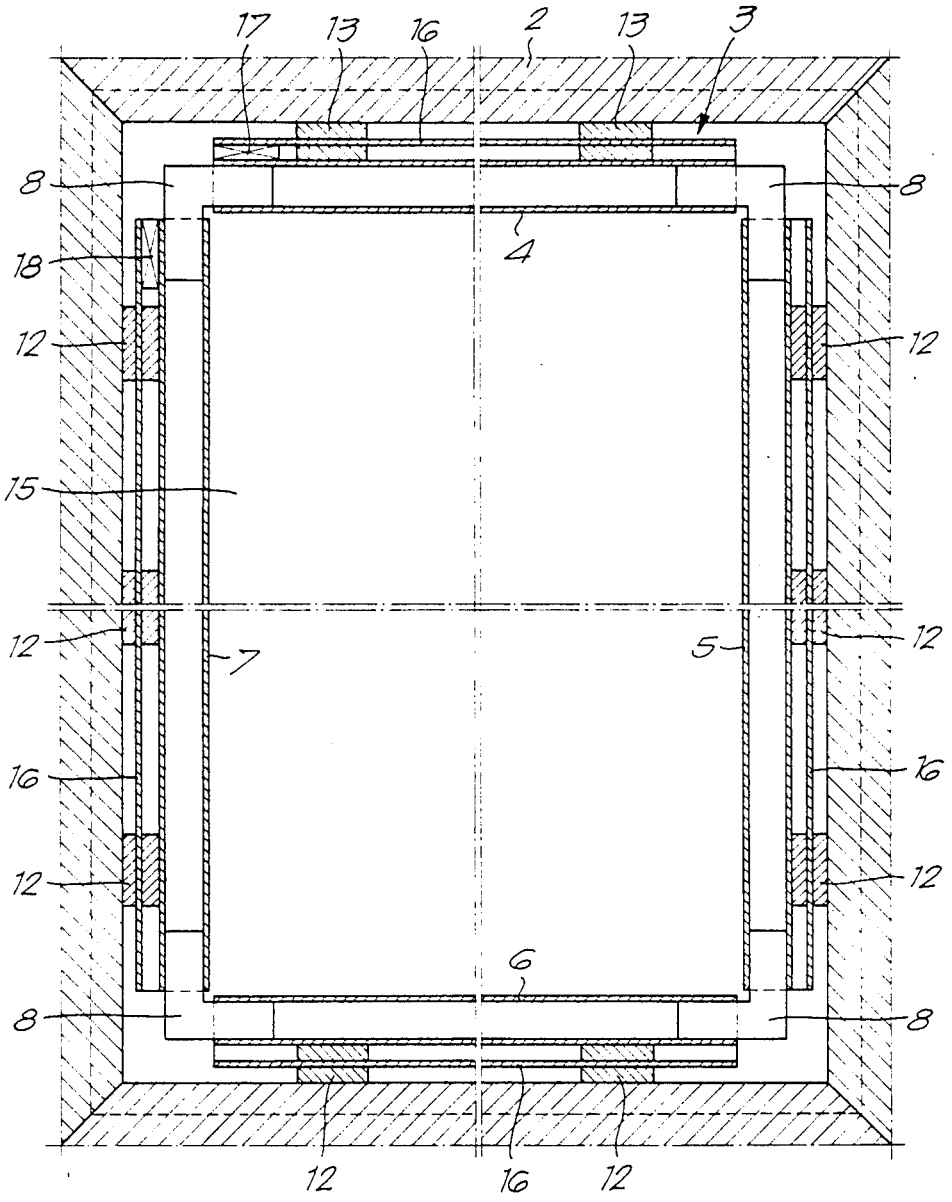
FIG. 3 shows a section according to line III—III in FIG. 1.

The frame 3 is formed by the aforesaid profiles 4 through 7 and the corner pieces 8, of which in the embodiment according to the FIGS. 1 through 3, three will be made of metal, and one will be made of an electric insulating material, preferably plastic. These profiles will furthermore, completely or not completely, be filled previously with a moisture absorbing means which can absorb the liquid which is in the space 15 existing between the glass panels and keep this space dry, whereby the profiles 4 through 7 are provided with an L-shaped rib 16 with which, on the one hand, the spacers 12 and 13 can cooperate in order to keep the latter at the correct place and whereby also electrodes, which are schematically shown in FIG. 3, can appropriately cooperate in order to heat the frame 3, whereby the corner piece 8, at the location of the electrodes 17 and 18 will be made of plastic material in order to force the current to run along the whole frame 3.

Preferably one or more small holes shall be provided in the profiles, which hole or holes form a continuous communication with the space between the glass panels in order in this way appropriately to put the moisture absorbing means in communication with the aforesaid space.

This frame 3, more especially the profiles 4 through 7, furthermore have notches 19 wherein the material of the strips 9 can penetrate to obtain an even better assembly and relative immobility between the frame 3 and the strips 9.

To form the double glass covering according to the invention, it suffices to de-fat and clean very thoroughly the inside of the glass set 1, after which, against this glass set, the frame 3, provided with the strips 9, can be fitted, whereby one uses, at the under edge, spacers 12 with a relative great length, so that these also can form a support for the frame 3 and the glass plate 11 still to be fitted and at the sides and upper edge spacers 13 which can be formed for instance by a spacer 12 the outside part of which is broken off.

Next one will fit the electrodes 17 and 18 and heat the frame 3 by means of an electric current, due to which the strips 9 become soft and so to say are being fixed through vulcanization against the glass plates 1 and 11 and against the frame 3, more especially the profiles 4 through 7 and the four corner pieces 8, which on each side are also provided with a layer of meltable material, for instance butyl, whereby the correct distance between the glass plates 1 and 11 is maintained due to the presence of the spacers 10.

Next, the electrodes 17 and 18 are removed and, for instance after cooling down, one will put around the glass plate 11 a sealing, respectively bedding paste 20 for the glass 11. The whole is finally finished through providing for a finishing lath of PVC, aluminium or the like 14 over the paste 20 and partly over the glass plate 11.

Figure 4:
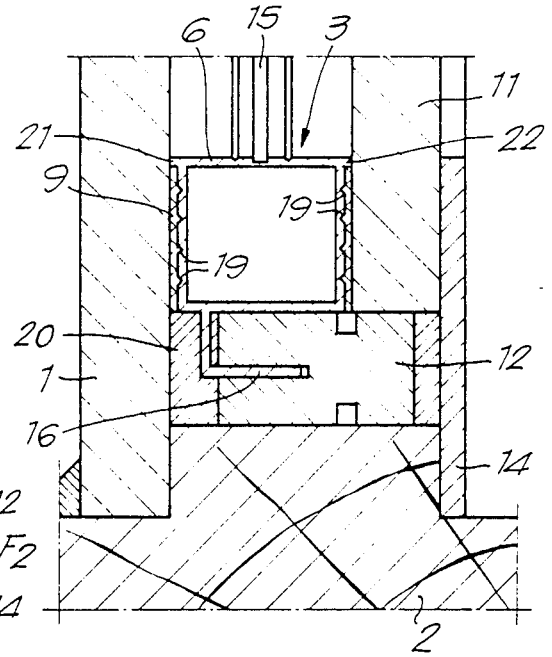
FIG. 4 shows a view similar to that of FIG. 2, but for a variant of execution.

In FIG. 4 there is shown a variant of execution which differs from the preceding one only by the fact that the spacers 10 are omitted and the projections 21–22 of the frame 3 take over their functions.

In still an other application one could place in the space formed by the lip 16 a thick resistance wire which heats up the frame.

Through arranging a double glass set as described hereinabove one thus obtains that, due to the presence of the spacers 10 (FIG. 2) or of the projections 21–22 (FIG. 4), the strips 9 have assuredly the necessary and equal regular thickness, whilst also, in the embodiment according to FIG. 4, the contact between the air in the space 15 and the material 9 is nearly non existing.

One also obtains in an embodiment according to FIG. 4 a fair arrangement of the projections 21–22 in relation to the glass.

The frame 3 will show a very great stability, amongst others, through the presence of the projections 21–22 and lip 16, which influences well the ease with which the frame can be treated and placed and thereafter the rigidity of the frame concerned or the like.

Finally, it may be mentioned that, when one uses an electric resistance which is placed in the space between the lip 16 and the profile properly speaking, burning through of the resistance becomes impossible thanks to the large section which it may have at this place; through the central location of the resistance one obtains a very equal repartition of the heat; as the resistance has a great mass, it must not be heated much more than to the heat which the frame 3 must obtain, so that, on the one hand, there can be no degeneration of the butyl and, on the other hand, a deformation of frame 3 is excluded.

The present invention of course is not limited to the embodiments described as examples and shown in the attached drawings, but such a double glass set can be realized in various shapes and dimensions without going outside the frame of the invention.

I claim:

1. A double glass set comprising:

a first glass plate;

a second glass plate;

a spacer disposed between said plates and along a periphery thereof, said spacer having lateral sides adhered to the glass plates through a layer of an adhesive material forming an airtight seal between the spacer and the glass plates, the spacer being formed from hollow metallic members, having a rectangular cross-section, wherein each spacer member has an outside wall provided with a rib in the form of an L, said L-shaped rib having a free leg oriented towards the second glass plate, wherein the spacer members are connected by corner pieces, one of which is electrically insulating and all the others of which are electrically conductive; and means for controlling the spacing between the spacer and the corresponding adjacent face of the glass plate, at both sides of the spacer.

2. A double glass set according to claim 1, wherein said means comprises portions of an inside wall of each spacer member, which extend beyond side walls, said each spacer member thereby forming projecting ribs.

3. A double glass set according to claim 1, wherein said means comprises a spacing component that is provided in the layer of adhesive material.

4. A double glass set according to claim 3, wherein said spacing component is in the form of a thread.

5. A double glass set according to claim 1, wherein distance blocks are provided at a lower side of the spacer to separate the spacer from a corresponding beam of a framework for the glass set, said distance blocks extending from a side of the first glass plate to a position below the second glass plate.

6. A double glass set according to claim 1, wherein an electric resistance is provided in a space defined by one of said ribs on an outside wall of one of the spacer members.

7. A double glass set comprising:

a first glass plate;

a second glass plate;

a spacer disposed between said plates and along a periphery thereof, said spacer having lateral sides adhered to the glass plates through a layer of an adhesive material forming an airtight seal between the spacer and the glass plates, the spacer being formed from hollow metallic members, having a rectangular cross-section, wherein each spacer member has an outside wall provided with a rib in the form of an L, said L-shaped rib having a free leg oriented towards the second glass plate, wherein an electric resistance is provided in a space defined by one of said ribs on an outside wall of one of the spacer members; and means for controlling the spacing between the spacer and the corresponding adjacent face of the glass plate, at both sides of the spacer.

8. A double glass set according to claim 7, wherein said means comprises portions of an inside wall of each spacer member, which extend beyond side walls, said each spacer member thereby forming projecting ribs.

9. A double glass set according to claim 7, wherein said means comprise a spacing component that is provided in the layer of adhesive material.

10. A double glass set according to claim 9, wherein said spacing component is in the form of a thread.

11. A double glass set according to claim 7, wherein distance blocks are provided at a lower side of the spacer to separate the spacer from a corresponding beam of a framework for the glass set, said distance blocks extending from a side of the first glass plate to a position below the second glass plate.

12. The double glass set of claim 1, wherein said electrically conductive corner pieces are metal.

13. The double glass set of claim 1, wherein said electrically insulating corner piece is plastic.

14. A double glass set comprising:

a first glass plate;

a second glass plate;

a spacer disposed between said plates and along a periphery thereof, said spacer having lateral sides adhered to the glass plates through a layer of an adhesive material forming an airtight seal between the spacer and the glass plates, the spacer being formed from hollow metallic members, having a rectangular cross-section, wherein each spacer member has an outside wall provided with a rib in the form of an L, said L-shaped rib having a free leg oriented towards the second glass plate, wherein the spacer members are connected by corner pieces, one of which is electrically insulating and all the others of which are electrically conductive.

15. A double glass set according to claim 14, wherein distance blocks are provided at a lower side of the spacer to separate the spacer from a corresponding beam of a framework for the glass set, said distance blocks extending from a side of the first glass plate to a position below the second glass plate.

16. A double glass set according to claim 14, wherein an electric resistance is provided in a space defined by one of said ribs on an outside wall of one of the spacer members.

17. A double glass set according to claim 14, wherein said electrically conductive corner pieces are metal.

18. A double glass set according to claim 14, wherein said electrically insulating corner piece is plastic.

* * * * *